US011741867B2

(12) United States Patent
Lee

(10) Patent No.: US 11,741,867 B2
(45) Date of Patent: Aug. 29, 2023

(54) DISPLAY DEVICE FOR PREVENTING DETERIORATION AND METHOD OF COMPENSATING THEREOF

(71) Applicant: LG Display Co., Ltd., Seoul (KR)

(72) Inventor: Won-Hee Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/554,984

(22) Filed: Dec. 17, 2021

(65) Prior Publication Data

US 2022/0208044 A1 Jun. 30, 2022

(30) Foreign Application Priority Data

Dec. 24, 2020 (KR) ..... 10-2020-0183334

(51) Int. Cl.
*G09G 3/00* (2006.01)
*G09G 3/3258* (2016.01)
*G09G 5/10* (2006.01)

(52) U.S. Cl.
CPC ..... *G09G 3/006* (2013.01); *G09G 3/3258* (2013.01); *G09G 5/10* (2013.01); *G09G 2320/0233* (2013.01); *G09G 2320/0295* (2013.01); *G09G 2320/045* (2013.01); *G09G 2320/048* (2013.01); *G09G 2330/12* (2013.01); *G09G 2360/16* (2013.01)

(58) Field of Classification Search
CPC ..... G09G 3/006; G09G 3/3258; G09G 5/10; G09G 2320/0233; G09G 2320/045; G09G 2320/048; G09G 2320/0295; G09G 2330/12; G09G 2360/16
USPC ..... 345/690
See application file for complete search history.

(56) References Cited

U.S. PATENT DOCUMENTS

2003/0201727 A1* 10/2003 Yamazaki ..... G09G 3/3291 315/169.1
2014/0368556 A1* 12/2014 Funatsu ..... G09G 3/3241 345/76
2015/0255019 A1* 9/2015 Park ..... G09G 3/3225 345/208
2016/0189634 A1* 6/2016 Kim ..... G09G 3/3406 345/691
2017/0076668 A1* 3/2017 Matsui ..... G09G 3/3233
2017/0193909 A1* 7/2017 Song ..... G09G 3/2074
2018/0151117 A1* 5/2018 Choi ..... G09G 3/3225
2020/0211454 A1* 7/2020 Ohnishi ..... G09G 3/30
2021/0183296 A1* 6/2021 Lee ..... G09G 3/2003
2021/0343241 A1* 11/2021 Seo ..... G09G 3/3258
2022/0044623 A1* 2/2022 Park ..... H05K 1/189

FOREIGN PATENT DOCUMENTS

KR 10-2019-0074847 A 6/2019

* cited by examiner

*Primary Examiner* — Tom V Sheng
(74) *Attorney, Agent, or Firm* — Fenwick & West LLP

(57) ABSTRACT

A display device includes a display panel including a plurality of sub pixels, a deterioration compensating unit configured to compensate for a deteriorated sub pixel based on a sensing voltage inputted from the display panel and dimming the plurality of sub pixels responsive to the compensation, and a memory configured to store a lookup table, the lookup table including gain, deterioration compensating timing, and target luminance.

16 Claims, 9 Drawing Sheets

DISPLAY DEVICE FOR PREVENTING DETERIORATION AND METHOD OF COMPENSATING THEREOF

CROSS-REFERENCE TO RELATED APPLICATION

This application claims the priority benefit of Republic of Korea Patent Application No. 10-2020-0183334, filed Dec. 24, 2020, which is incorporated by reference in its entirety.

BACKGROUND

The present disclosure relates to display device for preventing or at least reducing deterioration and method of compensating thereof.

As multimedia develops, the importance of flat panel display is increasing. As such, flat panel display devices such as liquid crystal display devices, plasma display devices, and organic light emitting display devices have been commercialized. Among these flat panel display devices, the organic light emitting display device is currently widely used in because of a high response speed, high luminance, and good viewing angle.

However, the luminance characteristics of the organic light emitting display panel may deteriorate due to deterioration of the organic light emitting device after a certain period of time. When the driving time increases, the deterioration rate of the organic light emitting diode is accelerated, and the luminance characteristic is rapidly deteriorated.

SUMMARY

An objective of the present disclosure is to provide a display device and a method of compensating deterioration and preventing or at least reducing the increase of power consumption.

In order to achieve the objective, the display device comprises a display panel including a plurality of sub pixels, a deterioration compensating unit configured to compensate for the deterioration of a deteriorated sub pixel based on a sensing voltage inputted from the display panel and dimming the plurality of sub pixels responsive to the compensation, and a memory configured to store a lookup table, the lookup table including gain, deterioration compensating timing, and target luminance.

The deterioration compensating timing may be determined by a number of driving or driving times of the display panel.

The target luminance is varied according to the deterioration compensating timing, and the target luminance may be set such that a current applied to the sub pixels after deterioration compensation and dimming is equal to or less than an initial current The deterioration compensating unit may include a deterioration compensating gain value calculating unit configured to calculate a deterioration compensating gain value based on the sensing voltage inputted from the display panel, a dimming weight value calculating unit configured to calculate a dimming weight value based on the deterioration compensating gain value inputted from the deterioration compensating gain value calculating unit and the target luminance inputted from the memory, and a data modulation unit configured to modulate data inputted to the display panel based on the deterioration compensating gain value inputted from the deterioration compensating gain value calculating unit and the dimming weight value inputted from the dimming weight value calculating unit.

The luminance of the deteriorated sub pixel may be raised to an initial luminance by the deterioration compensating gain value and the luminance of all the sub pixels may be decreased to the target luminance by the dimming weight value. The dimming weight value may be fixed or can be varied as the deterioration is accumulated.

A method of compensating deterioration of a display device, comprising inputting a sensing voltage from a sub pixel of a display panel, determining a gain corresponding to the inputted sensing voltage to calculate deterioration compensating gain value based on a look-up table, compensating a luminance of the sub pixel that is deteriorated according to the deterioration compensating gain value, calculating a dimming weight value by a target luminance and the deterioration compensating gain value, modulating data according to the dimming weight value, and supplying the modulated data to the display panel.

DETAILED DESCRIPTION

Figure 1:
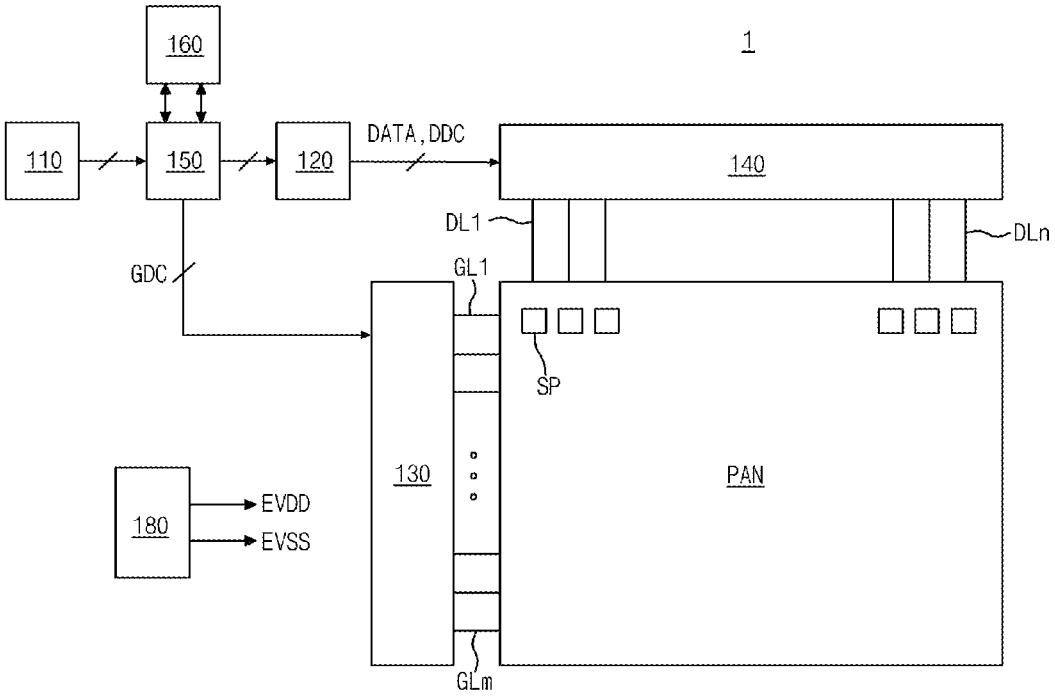
FIG. 1 is a schematic block diagram according to one embodiment of the present disclosure.

Advantages and features of the present disclosure and methods for achieving them will be made clear from embodiments described in detail below with reference to the accompanying drawings. The present disclosure may, however, be implemented in many different forms and should not be construed as being limited to the embodiments set forth herein, and the embodiments are provided such that this disclosure will be thorough and complete and will fully convey the scope of the present disclosure to those skilled in the art to which the present disclosure pertains, and the present disclosure is defined only by the scope of the appended claims.

Shapes, sizes, ratios, angles, numbers, and the like disclosed in the drawings for describing the embodiments of the present disclosure are illustrative, and thus the present disclosure is not limited to the illustrated matters. The same reference numerals refer to the same components throughout this disclosure. Further, in the following description of the present disclosure, when a detailed description of a known related art is determined to unnecessarily obscure the gist of the present disclosure, the detailed description thereof will be omitted herein. When terms such as "including," "having," "comprising," and the like mentioned in this disclosure are used, other parts may be added unless the term "only" is used herein. When a component is expressed as being singular, being plural is included unless otherwise specified.

In analyzing a component, an error range is interpreted as being included even when there is no explicit description.

In describing a positional relationship, for example, when a positional relationship of two parts is described as being "on," "above," "below," "next to," or the like, unless "immediately" or "directly" is not used, one or more other parts may be located between the two parts.

In describing a temporal relationship, for example, when a temporal predecessor relationship is described as being "after," "subsequent," "next to," "prior to," or the like, unless "immediately" or "directly" is not used, cases that are not continuous may also be included.

Although the terms first, second, and the like are used to describe various components, these components are not substantially limited by these terms. These terms are used only to distinguish one component from another component. Therefore, a first component described below may substantially be a second component within the technical spirit of the present disclosure.

In describing components of the specification, the terms first, second, A, B, (a), (b), and the like can be used. These terms are intended to distinguish one component from other components, but the nature, sequence, order, or number of the components is not limited by those terms. When components are disclosed as being "connected," "coupled," or "in contact" with other components, the components can be directly connected or in contact with the other components, but it should be understood that another component(s) could be "interposed" between the components and the other components or could be "connected," "coupled," or "contacted" therebetween.

In the specification, a "display device" may include display devices such as liquid crystal modules (LCMs), OLED modules, and quantum dot (QD) modules, and the like which include display panels and drivers for driving the display panels. In addition, the display device may also include laptop computers, televisions, and computer monitors which are complete products or final products including LCMs, OLED modules, QD modules, or the like, equipment displays including automotive displays or other types of vehicles, and set electronic devices, set devices, or set apparatuses such as mobile electronic devices such as smartphones or electronic pads.

Thus, the display device in the specification may include display devices in a narrow sense, such as LCMs, OLED modules, QD modules, or the like, and application products or set devices which are end consumer devices, which include the LCMs, the OLED modules, the QD modules, or the like.

In addition, in some cases, it may be separately expressed that LCMs, OLED modules, and QD modules, which include display panels and drivers, are expressed as "display devices" in some cases, and electronic devices as complete products including the LCMs, the OLED modules, or QD modules are expressed as "set devices." For example, the display device in a narrow sense may be a concept including a display panel such as a liquid crystal display (LCD) panel, an OLED panel, or a QD display panel, and a source printed circuit board (PCB) which is a controller for driving the display panel, and the set device may be a concept further including a set PCB which is a set controller which is electrically connected to the source PCB to control an entirety of the set device.

The display panel used in the present embodiment may employ various types of display panels such as a liquid crystal display panel, an OLED panel, a QD display panel, an electroluminescent display panel, and the like. However, the present disclosure is not limited to a specific display panel of which a bezel may be bent with a flexible substrate for an OLED panel of the present embodiment and a backplane support structure below the flexible substrate. In addition, the display panel used in the display device according to an embodiment of the specification is not limited to a shape or size of the display panel.

For example, when the display panel is an OLED panel, the display panel may include a plurality of gate lines, a plurality of data lines, and a plurality of pixels formed in intersection regions between the gate lines and the data lines. In addition, each of the pixels may include an array including a thin film transistor (TFT) which is an element for selectively applying a voltage to each pixel, an OLED layer on the array, and an encapsulation substrate or an encapsulation layer, which is disposed on the array to cover the OLED layer. The encapsulation layer may protect the TFT and the OLED layer from an external impact and prevent moisture or oxygen from infiltrating into the OLED layer. In addition, a layer formed on the array may include an inorganic light emitting layer, e.g., a nano-sized material layer or a quantum dot.

Figure 2:
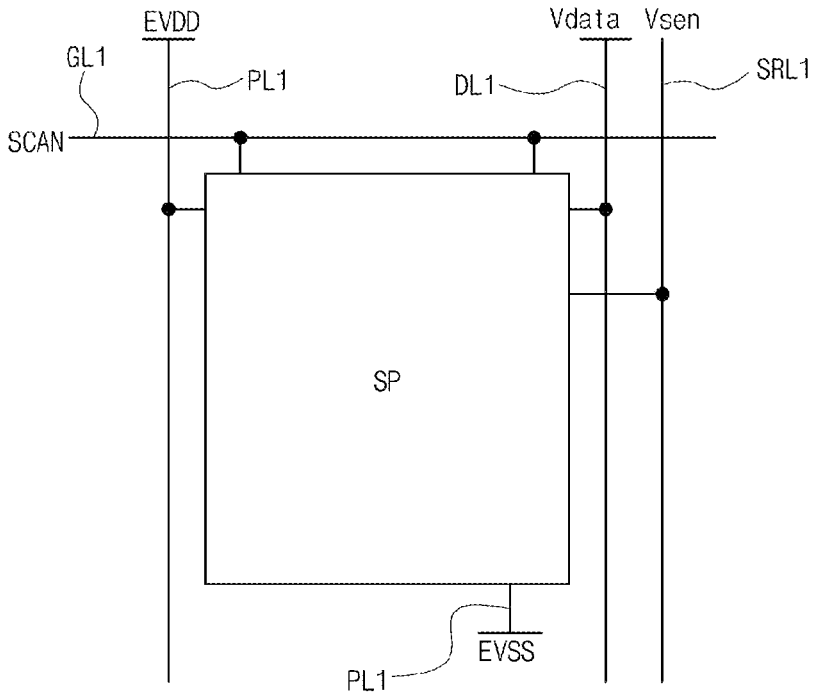
FIG. 2 is a schematic block diagram of a sub pixel of an organic light emitting display device according to one embodiment of the present disclosure.

FIG. 1 is the schematic block diagram and FIG. 2 is the schematic block diagram of the sub pixel of the organic light emitting display device according to one embodiment of the present disclosure.

As shown in FIG. 1, the organic light emitting display device 100 includes an image processing unit 110, a deterioration compensating unit 150, a memory 160, a timing controlling unit 120, a gate driving unit 130, a data driving unit 140, a power supplying unit 180, and a display panel PAN.

The image processing unit 110 outputs an image data supplied from outside and a driving signal for driving various devices. For example, the driving signal from the image processing unit 110 can include a data enable signal, a vertical synchronizing signal, a horizontal synchronizing signal, and a clock signal.

The deterioration compensating unit 150 calculates the deterioration compensating gain value of the sub pixel of the display panel based on a sensing voltage Vsen supplied from the data driving unit 140. The deterioration compensating unit 150 calculates dimming weight based on the calculated deterioration compensating gain value. Thereafter, the deterioration compensating unit 150 modulates the input image data Idata of each sub pixel at present frame by the calculated deterioration compensating gain value and dimming weight and then supplies the modulated image data Mdata to the timing controlling unit 120.

The modulated image data Mdata modulated by the deterioration compensating unit 150 and the driving signal are supplied to the timing controlling unit 120. The timing controlling unit 120 generates and outputs gate timing controlling signal GDC for controlling the driving timing of the gate driving unit 130 and data timing controlling signal DDC for controlling the driving timing of the data driving unit 140 based on the driving signal from the image processing unit 110.

The timing controlling unit 120 controls the driving timing of the gate driving unit 130 and the data driving unit 140 to obtain at least one sensing voltage Vsen from each sub pixel SP and supply to the obtained sensing voltage Vsen to the deterioration compensating unit 150.

The gate driving unit 130 outputs the scan signal to the display panel PAN in response to the gate timing control signal GDC supplied from the timing controlling unit 120. The gate driving unit 130 outputs the scan signal through a plurality of gate lines GL1 to GLm. In this case, the gate driving unit 130 may be formed in the form of an integrated circuit (IC), but is not limited thereto.

The data driving unit 140 outputs the data voltage to the display panel PAN in response to the data timing control signal DDC input from the timing controlling unit 120. The data driving unit 140 samples and latches the digital data signal DATA supplied from the timing controlling unit 120 to convert it into the analog data voltage based on the gamma voltage. The data driving unit 140 outputs the data voltage through the plurality of data lines DL1 to DLn.

Further, the data driving unit 140 supplies the sensing voltage Vsen input from the display panel PAN to the deterioration compensating unit 150 through a sensing voltage readout line.

In this case, the data driving unit 140 may be mounted on the top surface of the display panel PAN in the form of an integrated circuit (IC) or may be formed by stacking various patterns and layers directly on the display panel PAN, but is not limited thereto.

The power supplying unit 180 outputs high potential driving voltage EVDD and lower potential driving voltage EVSS etc. to these supply to the display panel PAN. The high potential driving voltage EVDD and the lower potential driving voltage EVSS is supplied to the display panel PAN through the power line. In this time, the voltage from the power supplying unit 180 are applied to the data driving unit 140 or the gate driving unit 130 to drive thereto.

The display panel PAN displays the image based on the data voltage and the scan signal from the data driving unit 140 and the gate driving unit 130 and the power from the power supplying unit 180.

The display panel includes a plurality of sub pixels SP to display the image. The sub pixel SP can include red sub pixel, green sub pixel, and blue sub pixel. Further, the sub pixel SP can include white sub pixel, the red sub pixel, the green sub pixel, and the blue sub pixel. The white sub pixel, the red sub pixel, the green sub pixel, and the blue sub pixel may be formed in the same area or may be formed in different areas.

The memory 160 stores a lookup table of the deterioration compensation gain and the deterioration compensation timing of the organic light emitting device of the sub pixel SP. In this case, the deterioration compensation timing of the organic light emitting device may be the driving number or the driving time.

As shown in FIG. 2, one sub pixel SP may be connected to the gate line GL1, the data line DL1, the sensing voltage readout line SRL1, and the power line PL1. The number of transistors and capacitors and the driving method of the subpixel SP are determined according to the circuit configuration.

Figure 3:
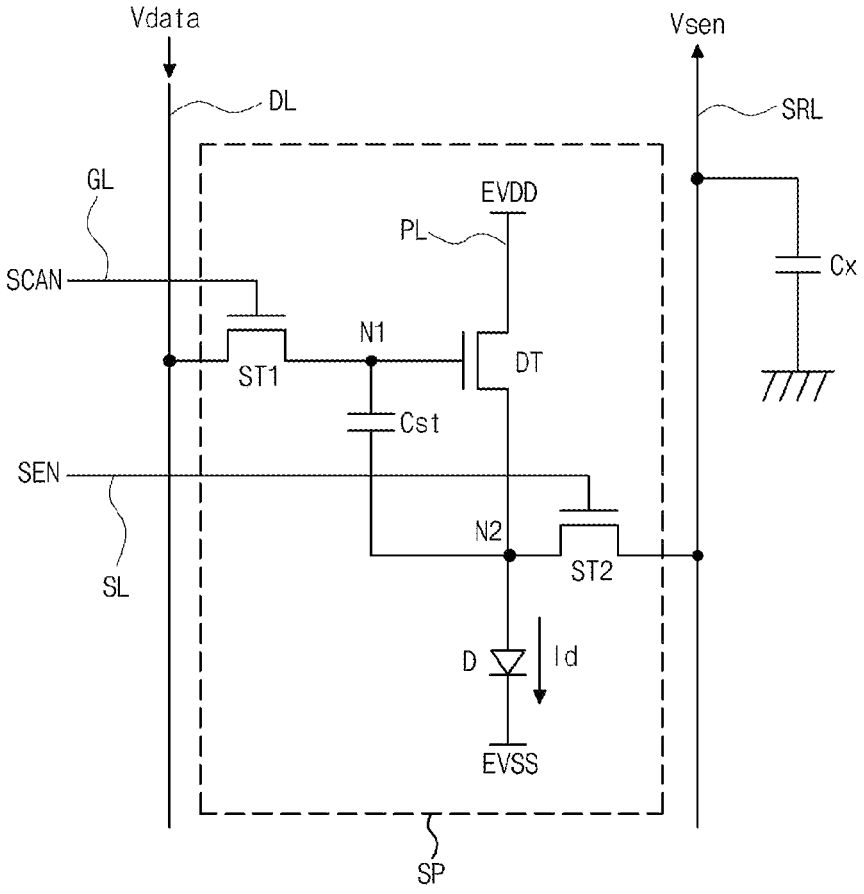
FIG. 3 is a circuit diagram of the sub pixel of the organic light emitting display device according to one embodiment of the present disclosure.

FIG. 3 is the circuit diagram illustrating the sub pixel SP of the organic light emitting display device 100 according to one embodiment of the present disclosure.

As shown in FIG. 3, the organic light emitting display device 100 includes the gate line GL and the data line DL, the power line PL, and the sensing line SL crossing each other for defining the sub pixel SP. A driving TFT DT, an organic light emitting device D, a storage capacitor Cst, a first switch TFT ST1, and a second switch TFT ST2 are disposed in the sub pixel SP.

The organic light emitting device D includes an anode electrode connected to a second node N2, a cathode electrode connected to an input terminal of the low potential driving voltage EVSS, and an organic light emitting layer disposed between the anode electrode and the cathode electrode.

The driving TFT DT controls the current Id flowing through the organic light emitting diode D according to the gate-source voltage Vgs. The driving TFT DT includes a gate electrode connected to a first node N1, a drain electrode connected to the power line PL to provide the high potential driving voltage EVDD, and a source electrode connected to the second node N2.

The storage capacity Cst is connected between the first node N1 and the second node N2.

When the display panel PAN is working, the first switch TFT ST1 applies the data voltage Vdata charged in the data line DL to the first node N1 in response to the gate signal (or scan signal) SCAN to turn on the driving TFT DT. In this case, the first switch TFT ST1 includes a gate electrode connected to the gate line GL to receive a scan signal SCAN, a drain electrode connected to the data line DL to receive a data voltage Vdata, and a source electrode connected to first node N1.

The second switch TFT ST2 switches the current between the second node N2 and the sensing voltage readout line SRL in response to the sensing signal SEN to store the source voltage of the second node N2 in a sensing capacitor Cx of the sensing voltage readout line SRL. The second switch TFT ST2 switches the current between the second node N2 and the sensing voltage readout line SRL in response to the sensing signal SEN when the display panel PAN is working to reset the source voltage of the driving TFT DT into the initial voltage Vpre. In this case, the gate electrode of the second switch TFT ST2 is connected to the sensing line SL, the drain electrode is connected to the second node N2, and the source electrode is connected to the sensing voltage readout line SRL.

In the organic light emitting display device 100 having such a structure, the organic light emitting layer deteriorates as the driving time increases, and the luminance is decreased and unrecoverable afterimage occurs as the using time of the organic light emitting device increases due to this deterioration. In order to solve the luminance degradation and the afterimage, it is necessary to increase the luminance to target luminance by compensating for deterioration of the organic light emitting layer.

The target luminance may be initial luminance of display panel PAN. When the target luminance is the initial luminance of display panel PAN, the deterioration of the organic light emitting layer should be compensated to raise the luminance lowered by the deterioration to the initial luminance. In order to raise the luminance, the current applied to the organic light emitting layer should be increased. Since increase of the current causes the increase of the power consumption, however, the deterioration of the organic light emitting layer is accelerated as the current applied to the organic light emitting device D is increased.

In other word, when the target luminance is the initial luminance of the display panel PAN, the organic light emitting layer is deteriorated as the usage time of the organic light emitting display device 100 is increased and thus the amount of the current applied to the organic light emitting device D is increased. This increase in the amount of current further accelerates the deterioration, so that the amount of current applied to the organic light emitting device D is further increased.

In one embodiment, the sub pixel in which the organic light emitting layer is deteriorated is compensated by dimming method. That is, the total luminance of the organic light emitting display device 100 is decreased by the dimming, so that the power consumption is minimized and the acceleration of the deterioration is prevented by preventing the increase of the current applied to the organic light emitting device D.

Figure 4:
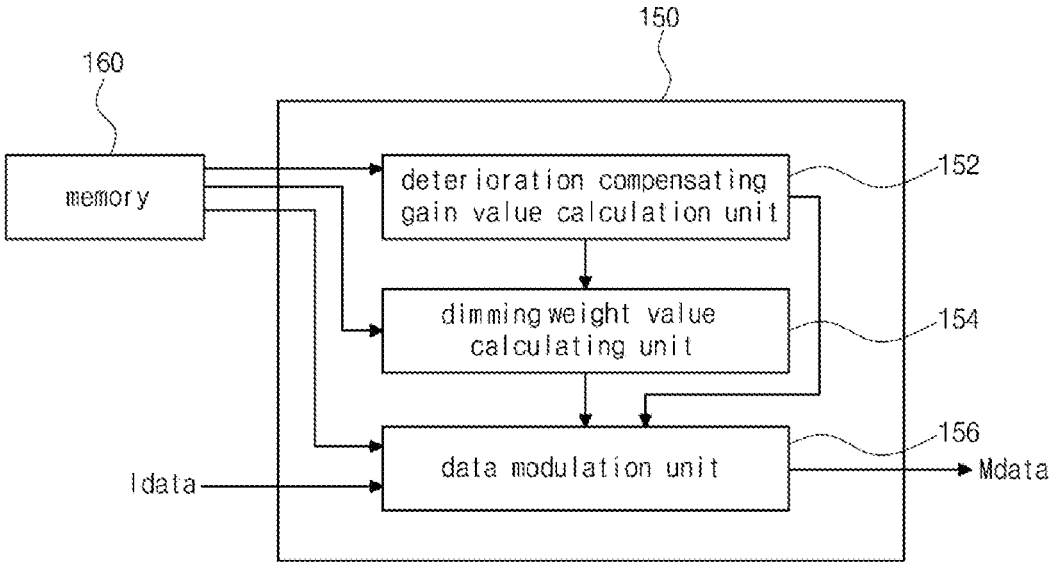
FIG. 4 is a block diagram illustrating a specific structure of a deterioration compensating unit of the organic light emitting display device according to one embodiment of the present disclosure.

FIG. 4 is the block diagram showing the specific structure of the deterioration compensating unit 150 according to one embodiment of the present disclosure.

As shown in FIG. 4, the deterioration compensating unit 150 includes a deterioration compensating gain value calculation unit 152, a dimming weight value calculating unit 154, and a data modulation unit 156.

The sensing voltage Vsen of the display panel PAN is applied to the deterioration compensating gain value calculation unit 152 from the data driving unit 140, so that the degradation compensation gain value at the deteriorated sub pixel SP or predetermined region is calculated based on the lookup table LUT stored in the memory 160 and then the calculated degradation compensation gain value is supplied to the dimming weight value calculating unit 154.

The dimming weight value calculating unit 154 calculates the dimming weight value based on the degradation compensation gain value calculated by the deterioration compensating gain value calculation unit 152 and the target luminance stored in the memory 160. The dimming weight value is the weight value for decreasing the luminance of the sub pixel SP corrected according to the degradation compensation gain value by a set amount. In this case, the deterioration compensating gain value corresponds to the deteriorated sub pixel SP, but the dimming weight value decreases the luminance of all sub pixels SP of the display panel PAN.

By decreasing the luminance of all sub pixels SP of the display panel PAN by the dimming weight value, the current applied to the sub pixel SP is decreased to minimize power consumption and to prevent the accelerated deterioration of the sub pixel caused by the increase of the current.

When the luminance of the deteriorated sub pixel SP is raised to the initial luminance by the deterioration compensating gain value, the amount of current supplied to the corresponding sub pixel SP is increased by an amount corresponding to the increase of the luminance to make the luminance of the deteriorated sub pixel equal to the luminance of the non-deteriorated sub pixel, so that the current supplied to the deteriorated sub pixel SP is increased. Thus, the power consumption is increased and the deterioration of the sub pixel SP is accelerated by the increased current.

The dimming weight value lowers the luminance of the sub pixel SP compensated by the deterioration compensating gain value by a preset amount. In particular, the dimming weight value not only lowers the luminance of the sub pixel SP in which deterioration is compensated, but also lowers the luminance of the non-deteriorated sub pixel SP. In other words, the luminance of all sub pixels SP of the organic light emitting display device 100 is lowered by the dimming weight value.

In case where the luminance of the sub pixel (or the region including a plurality of sub pixels) is lowered by the deterioration of the corresponding sub pixel, the user recognizes the deterioration of the sub pixel by the luminance difference between the deteriorated sub pixel (or the region) and the non-deteriorated sub pixel (or the region). That is, the stain is occurred in the deteriorated sub pixel (or the region) due to the decrease of the luminance and user recognizes the poor image by this stain.

In one embodiment, the luminance of the deteriorated sub pixel SP deteriorated is compensated to be equal to the luminance of the non-deteriorated sub pixel SP by the deterioration compensating gain value, and the luminance of the entire display device (i.e., the deteriorated sub pixels SP and the non-deteriorated sub pixels) is decreased by the dimming weight value. Accordingly, the increase of the current supplied to the sub pixels SP can be prevented or minimized, and the luminance of all the sub pixels SP of the organic light emitting display device 100 is made the same. As a result, since there is no need to increase the current supplied to the sub pixels SP, it is possible to prevent the increase of the power consumption due to the increase of the current, and the user cannot recognize the stain caused by the deteriorated sub pixels SP.

In one embodiment, although the entire screen of the organic light emitting display device 100 is darkened by the decrease of the luminance, since the stains due to the deterioration are not recognized by the user, it is possible to prevent fatal image quality deterioration that can be recognized by the user.

The dimming weight value may be set in various values. For example, the dimming weight value may be constant value such as 0.7, 0.8, and 0.9 etc. Further, the dimming weight value may be constant value and variable value. That is, as time lapses or the deterioration continues, the dimming weight value may be fixed or variable as the deterioration is accumulated.

The data modulation unit 156 modulates the input image data Idata of each sub pixel SP of the current frame by the calculated degradation compensating gain value and the dimming weight value, and then supplies the modulated image data Mdata to the timing controller 120.

The lookup table including the gain, the target luminance, and deterioration compensating timing is stored in the memory 160.

The lookup table LUT according to one embodiment may be in the form of a linear function with respect to the sensing voltage Vsen and the gain. In addition, the lookup table LUT may be a table corresponding to the sensing voltage Vsen and the gain.

The dimming may be performed in real time, but may be performed after deterioration has accumulated. That is, the dimming weight value may be updated and dimming may be performed whenever the display panel PAN is driven, but the dimming weight value is updated and dimming may be performed whenever the display panel PAN is driven the set number of times or driven for a set time.

The memory 160 supplies the gain and the deterioration compensating timing according to the request of the deterioration compensating unit 150 and stores the deterioration compensating gain value and the dimming weight value calculated by the deterioration compensating unit 150.

Figure 5:
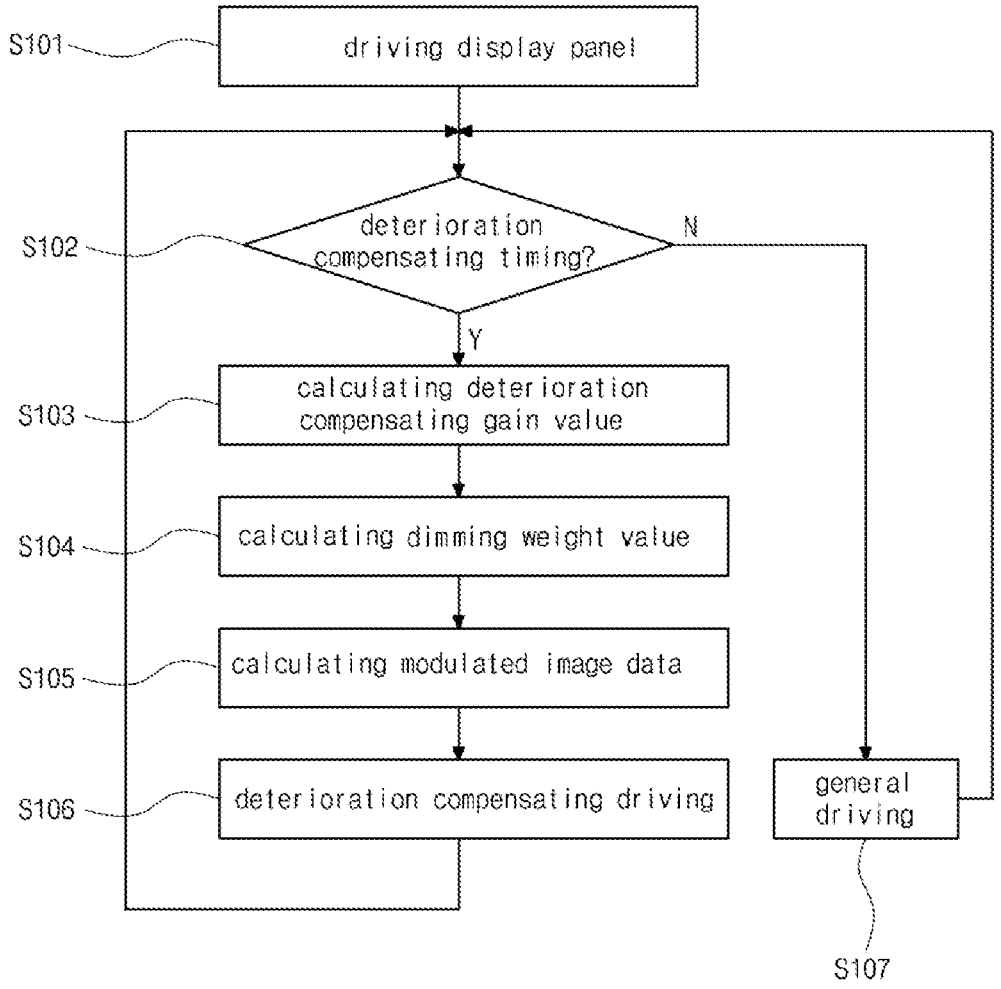
FIG. 5 is a flowchart illustrating a deterioration compensating method of the organic light emitting display device according to one embodiment of the present disclosure.

FIG. 5 is the flowchart illustrating the method for compensating for deterioration of the display device 100 according to one embodiment. A method of compensating for deterioration of the display device 100 will be described in detail with reference to FIGS. 1 to 5.

First, the image is displayed on the display panel PAN by driving the organic light emitting display device 100 (S101). In this case, the organic light emitting display device 100 is driven by turning on the driving TFT DT in response to the gate signal SCAN and supplying the input image data Idata to each sub pixel SP.

Thereafter, it is determined whether the organic light emitting display device 100 being driven is a deterioration compensating timing. If it is not the deterioration compensating timing, the organic light emitting display device 100 continues to be driven without compensating for deterioration, and the data voltage of the same magnitude as before is supplied to the display panel PAN, i.e., the organic light emitting display device 100 is in general driving (S107).

When the driving organic light emitting display device 100 is the deterioration compensating timing, the deterioration is compensated. The determination of the deterioration compensating timing may be performed in various ways. That is, the deterioration compensating timing may be determined by the deterioration compensating unit 150 reading the deterioration compensating timing stored in the memory 160, and the deterioration compensating timing may be determined by the timing controlling unit 120 reading the deterioration compensating timing stored in the memory 160.

The deterioration compensating timing of the organic light emitting display device 100 may be set by various methods and stored in the memory 160. The deterioration compensating timing of the display panel PAN may be determined according to the number of driving. For example, when the display panel PAN is driven 10,000 times, this may be determined as the deterioration compensating timing to compensate the deterioration. Further, the deterioration compensating timing of the display panel PAN may be determined according to the driving time. For example, when the display panel PAN is driven for 1000 hours, this may be determined as the deterioration compensating timing to compensate the deterioration.

The deterioration compensating timing may be periodically repeated. For example, whenever the display panel PAN is driven 10000N times (where N is a natural number), deterioration of the display panel PAN may be compensated (i.e., the deterioration of the display panel PAN is compensated whenever display panel PAN is driven 10000 times, 20000 times, or 30000 times . . . ). Further, whenever the display panel PAN is driven for 10000N times (here, N is a natural number), the deterioration of the display panel PAN may be compensated (i.e., the deterioration of the display panel PAN is compensated whenever display panel PAN is driven 10000 hours, 20000 hours, 30000 hours . . . ).

In addition, the deterioration compensation timing may be repeated aperiodically. Since the deterioration of the organic light emitting layer is gradually accelerated over time, the deterioration can be compensated at every small number of driving or at every short driving time.

For example, the deterioration of the display panel PAN can be compensated whenever the display panel PAN is driven 10000 times, 19000 times, 28000 times . . . and whenever the display panel PAN is driven 10000 hours, 19000 hours, 28000 hours . . . .

Various deterioration compensating timings may be stored in the memory 160, and a display device manufacturer or a user may select the deterioration compensating timing as needed. In addition, the deterioration compensation time may be selected according to the magnitude of the sensing voltage Vsen input from the display panel PAN. In this case, the deterioration compensating timing may be selected based on the lookup table of the sensing voltage Vsen stored in the memory versus the deterioration compensating timing stored in the memory.

The deterioration compensating unit 150 or the timing controlling unit 120 counts the number of driving or the driving time of the display panel PAN, and the current of same amount as before is applied to the organic light emitting display device 100 to display the image until the number of driving or the driving times of display panel PAN reach the deterioration compensating timing.

As a result of counting the number of driving or driving time of the organic light emitting display device 100, when number of driving or driving time of the organic light emitting display device 100 reaches the deterioration compensating timing (S102), the organic light emitting display device 100 is stopped and the deterioration compensating gain value is calculated (S103).

The deterioration compensating gain value is calculated by the deterioration compensating gain value calculating unit 152. The deterioration compensating gain value calculating unit 152 calculates the deterioration compensating gain value corresponding to the sensing voltage Vsen applied from the data driving unit 140 by the lookup table stored in the memory 160.

Figure 6:
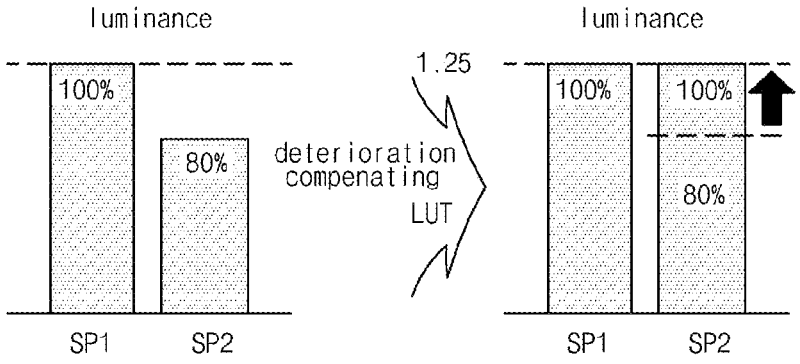
FIG. 6 is a diagram conceptually illustrating compensating for deterioration of luminance by a deterioration compensating gain value according to one embodiment of the present disclosure.

FIG. 6 is a diagram conceptually illustrating compensation for deterioration of luminance by the deterioration compensating gain value. In this case, SP1 is the sub pixel or the region in which deterioration has not occurred, and SP2 is the sub pixel or the region in which deterioration has occurred.

As shown in FIG. 6, when the luminance of the first sub pixel SP1 (or the region in which the deterioration does not occur) is 100% and the luminance of the deteriorated second sub pixel SP2 (or the region) is lowered to 80%, the deterioration compensating gain value for the deterioration of the second sub pixel SP2 is about 1.25. The deterioration compensating gain value calculating unit 152 detects that the luminance is decreased to 80% due to deterioration of the second sub pixel SP2 by the sensing voltage Vsen input from the data driving unit 140, and then calculates the corresponding deterioration compensating gain value of 1.25 by the lookup table stored in the memory 160.

At this time, by multiplying the luminance of the deteriorated second sub pixel SP2 by the deterioration compensation gain value of 1.25 (80%×1.25), the luminance of the second sub pixel SP2 becomes the same as the luminance (100%) of the non-deteriorated first sub pixel SP1, so that the decrease of the luminance caused by the deterioration can be compensated.

Referring back to FIG. 5, the dimming weight value calculating unit 154 of the deterioration compensating unit 150 calculates the dimming weight value (S104). The dimming weight value decreases the luminance of the first sub pixel SP1 and the second sub pixel SP2 which display the image in 100% luminance, so that the image is displayed with the target luminance.

The deterioration compensating gain value calculated by the deterioration compensating gain value calculating unit 152 and the target luminance stored in the memory is input to the dimming weight value calculating unit 154 and the dimming weight vale is calculated by the dimming weight value calculating unit 154.

Figure 7A:
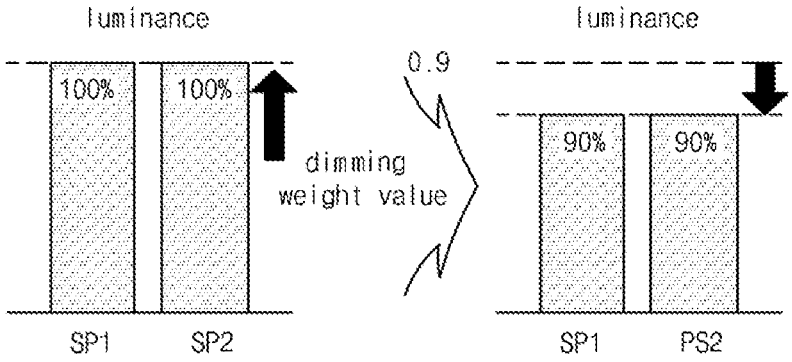
FIGS. 7A and 7B are diagrams conceptually illustrating respectively dimming of luminance by a dimming weight value according to one embodiment of the present disclosure.
Figure 7B:
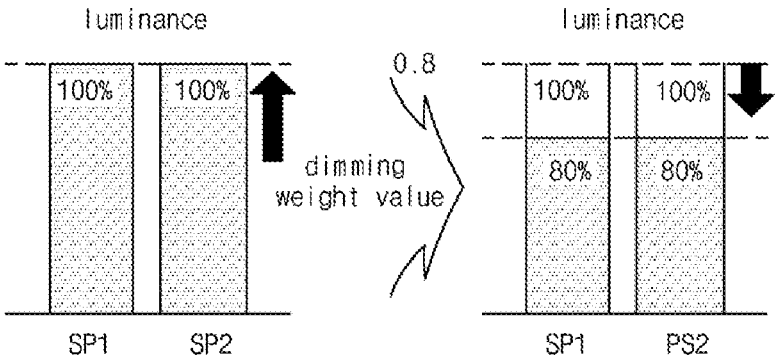

FIGS. 7A and 7B are diagrams conceptually illustrating dimming of luminance by the dimming weight value, respectively. In this case, FIGS. 7A and 7B show cases where the target luminance is 90% and 80% of the initial luminance, respectively. The target luminance may be variously set, such as 70% or 60%.

As shown in FIG. 7A, when the target luminance is 90% of the initial luminance, the dimming weight value calculating unit 154 calculates the dimming weight value of 0.9. If the first sub pixel SP1 which is 100% of the luminance without deterioration and the second sub-pixel SP2 in which the luminance is increased to 100% by compensating the deterioration are multiplied by the dimming weight value of 0.9 (100%×0.9), the luminance of all dimmed sub pixels SP1 and SP2 is decreased to 90% compared to the initial luminance.

As shown in FIG. 7B, further, when the target luminance is 80% of the initial luminance, the dimming weight value calculating unit 154 calculates the dimming weight value of 0.8. If the first sub pixel SP1 which is 100% of the luminance without deterioration and the second sub-pixel SP2 in which the luminance is increased to 100% by compensating the deterioration are multiplied by the dimming weight value of 0.8 (100%×0.8), the luminance of all dimmed sub pixels SP1 and SP2 is decreased to 80% compared to the initial luminance.

Referring back to FIG. 5, the input image data Idata is modulated into the image data Mdata based on the calculated dimming weight values and the modulated image data Mdata is supplied to the timing controlling unit 120 (S105). The timing controlling unit 120 supplies the modulated image data Mdata and the data timing control signal DDC to the data driving unit 140, and the data driving unit 140 converts the digitally modulated data signal Mdata into an analog data voltage based on the gamma voltage by sampling and latching the digitally modulated data signal Mdata. Thereafter, the converted data voltage is output to the display panel PAN through the plurality of data lines DL1 to DLn to compensate the deterioration and thus to drive the organic light emitting display device 100 (S106).

Figure 8A:
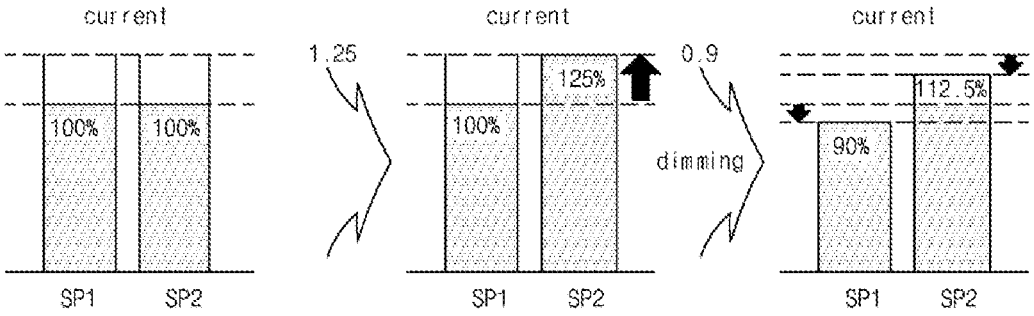
FIGS. 8A and 8B are diagrams conceptually illustrating respectively modulation of image data according to one embodiment of the present disclosure.
Figure 8B:
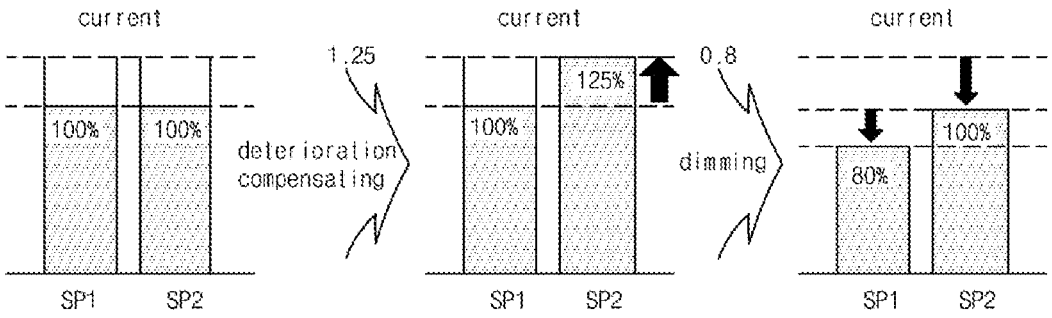

FIGS. 8A and 8B are diagrams conceptually illustrating modulation of image data Idata, respectively. In the drawings, image data Idata is expressed as a current for convenience of explanation. In this case, FIGS. 8A and 8B show a case where the target luminance is 90% and 80% of the initial luminance, respectively.

First, as shown in FIG. 6, when the luminance of the second sub pixel SP2 is deteriorated from 100% to 80%, the second sub pixel SP2 must be compensated by multiplying the luminance of the second sub pixel SP2 by the deterioration compensating gain value of 1.25 to increase the luminance of the deteriorated second sub pixel SP2 to the 100% which is the luminance of the first sub pixel SP1.

The amount of current applied to the second sub pixel SP2 should be increased to increase the luminance of the second sub-pixel SP2. In order to increase the luminance of the second sub pixel SP2 from 80% to 100%, the amount of current applied to the second sub pixel SP2 should be increased at the same rate. That is, as shown in FIG. 8A, if the amount of current applied to the second sub pixel SP2 is increased by multiplying the current applied to the second sub pixel SP2 by the deterioration compensating gain value of 1.25, the current of 125% is applied to the second sub pixel SP2 in case where the amount of the initial current applied to the first sub pixel SP1 is 100%.

Thereafter, when the target luminance is 90% of the initial luminance because of the dimming weight value of 0.9, the current applied to the first sub pixel SP1 and the second sub pixel SP2 are multiplied by the dimming weight value of 0.9 for dimming (SP1=100%×0.9, SP2=125%×0.9), so that the current applied to the first sub pixel SP1 is 90% and the current applied to the second sub pixel SP2 is 112.5%.

Therefore, when dimming is performed by setting the target luminance to 90% of the initial luminance, the current applied to the first sub pixel SP1 is decreased from 100% to 90%, and the current applied to the second sub pixel SP2 is decreased from 125% to 112.5%.

As shown in FIG. 8B, when the target luminance is 80% of the initial luminance because of the dimming weight value of 0.8, the current applied to the first sub pixel SP1 and the second sub pixel SP2 are multiplied by the dimming weight value of 0.8 for dimming (SP1=100%×0.8, SP2=125%×0.8), so that the current applied to the first sub pixel SP1 is 80% and the current applied to the second sub pixel SP2 is 100%.

Therefore, when dimming is performed by setting the target luminance to 80% of the initial luminance, the current applied to the first sub pixel SP1 is decreased from 100% to 80%, and the current applied to the second sub pixel SP2 is decreased from 125% to 100%.

As shown in FIGS. 7A and 8A, when the target luminance is 90% of the initial luminance, the luminance of the first and second sub pixels is decreased from the initial luminance of 100% to 90% and the currents applied to the first and second sub pixels SP1 and SP2 become respectively 90% and 112.5%.

As described above, in the organic light emitting display device 100 according to one embodiment, the deterioration compensation and the dimming are performed. Accordingly, compared to the case where only the deterioration compensation is performed and no dimming is performed, the luminance of the first sub pixel SP1 and the second sub pixel SP2 are both lowered, but there is no non-uniformity of the luminance between the non-deteriorated sub pixel SP1 and the deteriorated sub pixel SP1. As a result, the user cannot feel the image quality deterioration due to the decrease in luminance.

In addition, compared to a case where only deterioration compensation is performed and dimming is not performed, in the organic light emitting display device 100 according to one embodiment, the currents applied to the first sub pixel SP1 and the second sub pixel SP2 are decreased and thus the power consumption may be minimized.

As shown in FIGS. 7B and 8B, when the target luminance is 80% of the initial luminance, the luminance of the first and second sub pixels is decreased from the initial luminance of 100% to 80% and the currents applied to the first and second sub pixels SP1 and SP2 become respectively 80% and 100%.

Comparing to the case where only the deterioration compensation is performed and no dimming is performed, the luminance of the first sub pixel SP1 and the second sub pixel SP2 are both lowered, but there is no non-uniformity of the luminance between the non-deteriorated sub pixel SP1 and the deteriorated sub pixel SP1. As a result, the user cannot feel the image quality deterioration due to the decrease in luminance.

In addition, compared to a case where only deterioration compensation is performed and dimming is not performed, in the organic light emitting display device 100 according to one embodiment, the currents applied to the first sub pixel SP1 and the second sub pixel SP2 are not exceed the initial current. Thus, the increase of the power consumption may be prevented and the acceleration of the deterioration of the organic light emitting device D due to the increase of the current may be prevented.

In one embodiment, the target luminance can be variously set. For example, as described above, the target luminance may be set to the relative luminance of the initial luminance 90%, 80%, or 70% . . . . Further, the target luminance may be set as specific luminance of 550 nit, 540 nit, 530 nit . . . etc., not the relative luminance of the initial luminance.

In one embodiment, since the current applied to the first sub pixel SP1 and the second sub pixel SP2 during dimming is set to be equal to or smaller than the initial amount of the initial current, the power consumption can be minimized and the deterioration acceleration due to the increase of the current can be prevented. From this point of view, in one embodiment, it is preferable to set the target luminance to 80% or less of the initial luminance, but not limited thereto.

Referring back to FIG. 5, after the deterioration compensated driving of the organic light emitting display device 100 is continued, the number of driving or driving time is counted. When the next compensation timing is reached, deterioration compensation and dimming are performed again. In this case, the deterioration compensation and the dimming are performed based on the luminance and current of the current image, which has been compensated for deterioration and is dimmed in the previous compensation process, displayed on the organic light emitting display device 100.

Figure 9A:
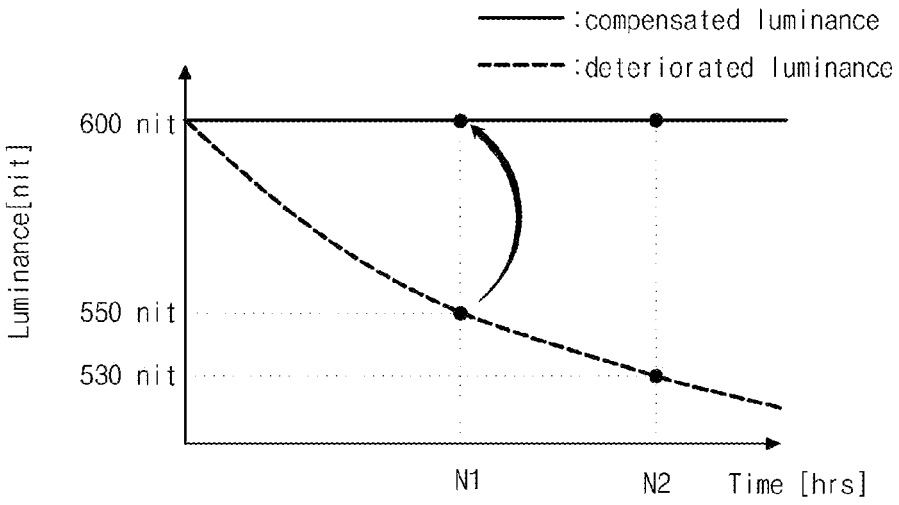
FIG. 9A is a graph illustrating the luminance of the deteriorated sub pixel and the luminance of the sub pixel in which the deterioration is compensated but not dimming according to one embodiment of the present disclosure.
Figure 9B:
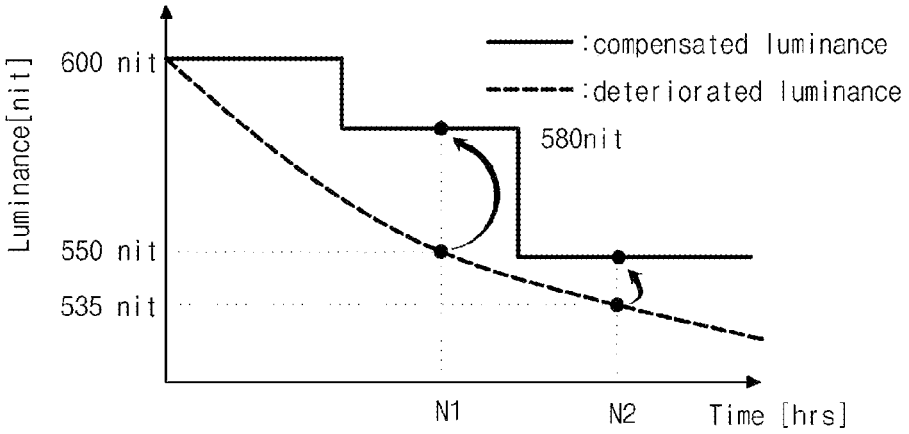
FIG. 9B is the graph illustrating the luminance of the deteriorated sub pixel and the luminance of the sub pixel in which the deterioration and dimming are performed according to one embodiment of the present disclosure.

FIG. 9A is the graph showing the luminance of the deteriorated sub pixel which has been compensated but not dimmed, and FIG. 9B is the graph showing the luminance of the deteriorated sub pixel which has been compensated and dimmed according to an embodiment of the present disclosure.

As shown in FIG. 9A, when the deterioration occurs, the luminance is gradually decreased, and the deterioration is accumulated and the luminance gradually decreases as time passes. As time elapses from the initial luminance of 600 nits, the luminance decreases to about 550 nits at the first deterioration compensating timing N1 and the luminance decreases to about 530 nits at the second deterioration compensating timing N2.

In order to compensate the luminance deteriorated at the first deterioration compensating timing N1 to the initial luminance (600 nit), the luminance of the deteriorated sub pixel should be increased by about 50 nits, and the amount of current applied to the sub pixel should be also increased by the luminance increase (that is, about 50 nits).

Further, in order to compensate the luminance of 530 nits, which is the luminance deteriorated at the second deterioration compensating timing N2, to the initial luminance (600 nit), the luminance of the deteriorated sub pixel should be increased by about 70 nits, and the amount of current applied to the sub pixel should be also increased by the luminance increase (that is, about 70 nits).

In other words, in the case of the deterioration compensation without the dimming, the deterioration becomes more severe as the driving time of the display panel PAN is accumulated, and the current for the compensation further increases. Since the increase of the current according to the accumulation of deterioration not only causes the increase of the power consumption but also accelerates deterioration, it is a cause of deterioration of the quality and lifetime of the organic light emitting display device 100.

On the contrary, as shown in FIG. 9B, in case of the deterioration compensation with the dimming, the target luminance is gradually decreased to 580 nit, 550 nit . . . , not fixed to the initial luminance (600 nit)

Therefore, at the first deterioration compensating timing N1 when the luminance is decreased to about 550 nits, the deteriorated luminance is compensated for the target luminance of 580 nits, not the initial luminance of 600 nits. In addition, although the current applied to the sub pixel must also be increased, since the target luminance 580 nits is significantly lowered compared to the initial luminance 600 nits, there is no substantial increase in the current or only a small amount increases even if the current increases.

When the dimming shown in FIG. 9B is not executed at the first deterioration compensating timing N1, the luminance of the sub pixel must be increased by about 50 nits, whereas the luminance of the sub pixel needs is increased by only about 30 nits in the present disclosure. Thus, the increment of the current applied to the sub pixel can be decreased.

Further, at the second deterioration compensating timing N2 when the deterioration is further advanced, the deteriorated luminance of 530 nits may be compensated to the target luminance of 550 nits, not to the initial luminance of 600 nits. When the dimming is not executed at the first deterioration compensating timing N1, the current supplied to the sub pixel is increased by 50 nits, whereas the current supplied to the sub pixel is increased only by 30 nits in one embodiment. Therefore, the current supplied to the sub pixel is decreased compared to the deterioration compensation without dimming. Accordingly, the sub pixel is less deteriorated compared to the sub pixel compensated without dimming. The sub pixel which is compensated without the dimming is deteriorated to 530 nits, whereas the sub pixel is deteriorated to 535 nit.

Accordingly, the luminance of the deteriorated sub pixel is raised by about 15 nits at the second deterioration compensating timing N2. Since this luminance increase is smaller than the decrease in the target luminance, there is no substantial increase in the current or only a small amount of the current is increased.

In other words, in the case of the deterioration compensation in an embodiment of the present disclosure, even when the deterioration becomes more severe as the driving time of the display panel PAN is accumulated, it is possible to prevent the increase of the current for compensation, so that the power consumption is minimized and the deterioration due to the increase of the current may be prevented.

As described above, in the organic light emitting display device 100, the target luminance lower than the initial luminance is set to compensate the deteriorated sub pixel, and the deterioration is not compensated by the initial luminance, but the deterioration to the target luminance. Accordingly, after compensating the deteriorated sub pixel with the luminance (initial luminance) of the non-deteriorated sub pixel, the luminance of the deteriorated sub pixel and the non-deteriorated sub pixel is decreased by dimming, so that the degradation can be compensated without the increase of the current. As a result, the increase of the power consumption and the acceleration of deterioration due to the increase of the current can be prevented.

Features, structures, effects, and the like which are described in the examples of the present disclosure are included in at least one example of the present disclosure and are not necessarily limited to only one example. In addition, the features, structures, effects, and the like described in at least one example of the present application disclosure may be combined or modified for other examples by those skilled in the art to which the present disclosure pertains. Therefore, contents related to such a combination and modification should be construed as being included in the scope of the present disclosure.

It should be understood that the embodiments of the present disclosure are not limited to the above described embodiments and the accompanying drawings, and various substitutions, modifications, and alterations can be devised by those skilled in the art without departing from the technical spirit of the present disclosure. Therefore, the scope of the present disclosure is defined by the appended claims, and all alternations or modifications derived from the meaning and scope of the claims and their equivalents should be construed as being included within the scope of the present disclosure.

What is claimed is:

1. A display device comprising:

a display panel including a plurality of sub pixels;

a deterioration compensating unit configured to compensate for deterioration of a deteriorated sub pixel based on a sensing voltage inputted from the display panel and dimming the plurality of sub pixels responsive to the compensation; and a memory configured to store a lookup table, the lookup table including gain, deterioration compensating timing, and target luminance, wherein the deterioration compensating unit includes:

a deterioration compensating gain value calculating unit configured to calculate a deterioration compensating gain value based on the sensing voltage inputted from the display panel;

a dimming weight value calculating unit configured to calculate a dimming weight value based on the deterioration compensating gain value inputted from the deterioration compensating gain value calculating unit and the target luminance inputted from the memory; and a data modulation unit configured to modulate data inputted to the display panel based on the deterioration compensating gain value inputted from the deterioration compensating gain value calculating unit and the dimming weight value inputted from the dimming weight value calculating unit.

2. The display device of claim 1, wherein the deterioration compensating timing is determined by a number of driving of the display panel.

3. The display device of claim 1, wherein the deterioration compensating timing is determined by driving times of the display panel.

4. The display device of claim 1, wherein the target luminance is varied according to the deterioration compensating timing.

5. The display device of claim 1, wherein the target luminance is set such that a current applied to the sub pixels after deterioration compensation and dimming is equal to or less than an initial current.

6. The display device of claim 1, wherein the luminance of the deteriorated sub pixel is raised to an initial luminance by the deterioration compensating gain value.

7. The display device of claim 1, wherein the luminance of all the sub pixels is decreased to the target luminance by the dimming weight value.

8. The display device of claim 7, wherein the dimming weight value is fixed.

9. The display device of claim 7, wherein the dimming weight value is varied as the deterioration is accumulated.

10. A method of compensating deterioration of a display device, comprising:

inputting a sensing voltage from a sub pixel of a display panel;

determining a gain corresponding to the inputted sensing voltage to calculate deterioration compensating gain value based on the sensing voltage inputted from the display panel;

compensating a luminance of the sub pixel that is deteriorated according to the deterioration compensating gain value;

calculating a dimming weight value based on a target luminance and the deterioration compensating gain value;

modulating data based on the deterioration compensating gain value and the dimming weight value; and supplying the modulated data to the display panel.

11. The method of claim 10, wherein the deterioration compensating gain value is calculated at each of a plurality of deterioration compensating timings.

12. The method of claim 11, wherein the target luminance is different at each of the plurality of deterioration compensating timings.

13. The method of claim 10, wherein compensating the luminance of the deteriorated sub pixel according to the deterioration compensating gain value includes compensating the luminance of deteriorated sub pixel to an initial luminance.

14. The method of claim 10, wherein an amount of a current of the modulated data is equal to or less than amount of an initial current supplied to the sub pixel.

15. A display device comprising:

a display panel including a plurality of sub pixels;

a memory configured to store a lookup table, the lookup table including gain, deterioration compensating timing, and target luminance; and a deterioration compensating unit configured to compensate for deterioration of a deteriorated sub pixel by a gain based on a sensing voltage inputted from the display panel and decease the luminance of all the sub pixels to the target luminance in association with the gain from the memory.

16. The display device of claim 15, wherein the deterioration compensating unit includes:

a deterioration compensating gain value calculating unit configured to calculate a deterioration compensating gain value based on the sensing voltage inputted from the display panel;

a dimming weight value calculating unit configured to calculate a dimming weight value based on the deterioration compensating gain value inputted from the deterioration compensating gain value calculating unit and the target luminance inputted from the memory; and a data modulation unit configured to modulate data inputted to the display panel based on the deterioration compensating gain value inputted from the deterioration compensating gain value calculating unit and the dimming weight value inputted from the dimming weight value calculating unit.

* * * * *